United States Patent [19]

Yoshida

[11] Patent Number: 4,715,099

[45] Date of Patent: Dec. 29, 1987

[54] TERMINAL CRIMPING MACHINE

[75] Inventor: Koji Yoshida, Kobe, Japan

[73] Assignee: Shin Meiwa Industry Co., Ltd., Nishinomiya, Japan

[21] Appl. No.: 904,340

[22] Filed: Sep. 5, 1986

[30] Foreign Application Priority Data

Jan. 16, 1986 [JP] Japan ..... 61-4966[U]
Jan. 24, 1986 [JP] Japan ..... 61-9505[U]

[51] Int. Cl.[4] ..... H01R 43/04
[52] U.S. Cl. ..... 29/33 M; 29/564.6
[58] Field of Search ..... 29/33 M, 33 P, 34 D, 29/563, 564.2, 564.3, 564.4, 564.6, 564.7, 564.8; 190/165

[56] References Cited

U.S. PATENT DOCUMENTS 3,961,703 6/1976 McKeever ..... 29/563
4,521,946 6/1985 Dusel et al. ..... 29/564.4

*Primary Examiner*—Z. R. Bilinsky

*Attorney, Agent, or Firm*—W. G. Fasse; D. H. Kane, Jr.

[57] ABSTRACT

A terminal crimping machine has an insulation stripping unit and a plurality of terminal crimping units disposed laterally of a transfer conveyor path. The transfer conveyor carries a number of wire transfer units for gripping insulated wires cut to predetermined lengths and travels intermittently. Each terminal crimping unit has a crimping bed for vertically moving from a position below the level of the ends of wires being transferred to the level of the ends of the wires. A crimping die is disposed above the crimping bed and adapted for vertical movement for crimping terminals. The arrangement is such that when a wire which corresponds to a particular one of the terminal crimping units is fed to that unit, in accordance with a signal from a separate control device, the corresponding crimping bed is raised while the crimping die is lowered to effect a terminal crimping operation. However, wires which do not correspond to the particular terminal crimping unit are allowed to pass thereover.

8 Claims, 12 Drawing Figures

TERMINAL CRIMPING MACHINE

BACKGROUND OF THE INVENTION

1. Field of the Invention

The present invention relates to improvements in a terminal crimping machine comprising crimping beds and crimping dies which cooperate with each other to crimp terminals against or onto wires cut to predetermined lengths and having their insulation stripped from their cut ends.

2. Description of the Prior Art

Conventional, in a continuous terminal crimping machine wires cut to predetermined lengths and having their insulations stripped from their ends, are gripped by wire transfer units and fed to a plurality of terminal crimping units for continuously crimping terminals. The wires are transferred at a given distance above the terminals placed on the crimping beds of the terminal crimping units so that the wires may not collide with any terminals present along th path of travel of the wires. Under these circumstances, if the wires are transferred at the end of the machine with excessive bends remaining in the wires, these excessively bent wires are in danger of being caught by the terminal crimping units at the end of the machine of even if the wires are successfully transferred, the after-treatment of the terminal-crimped, excessively bent wires is troublesome and the products become unsightly, detracting from their marketable value. Further, there has heretofore been a device wherein upon completion of the terminal crimping, the wires are bent upward by guides to correct their bends, but such a device is complicated.

SUMMARY OF THE INVENTION

Accordingly, it is an object of this invention to provide a terminal crimping machine constructed so that no bend remains in a wire having a terminal crimped thereto and hence a slightly, terminal-equipped cut wire is obtained.

A terminal crimping machine according to this invention comprises a transfer conveyor adapted to be intermittently driven for circulation and having a plurality of wire transfer units adapted to grip wires cut to predetermined lengths, an insulation stripping unit, and a terminal crimping unit which are disposed laterally of the path of travel of said tranfer conveyor. The terminal crimping unit comprises a crimping bed adapted for vertical movement from a position below the level of the ends of wires being transferred to the level of the ends of said wires, and a crimping die disposed above said crimping bed and adapted for vertical movement. Thus, when a wire is fed to the terminal crimping unit, the crimping bed disposed thereat is raised while the crimping die is lowered to crimp the terminal. Further, when a wire not to have a terminal crimped thereto by said terminal crimping unit, passes, the crimping bed assumes its lower position to allow passage of said wire.

In a preferred embodiment, a plurality of crimping units are provided and, in accordance with a signal from a control device, when a wire is fed to the terminal crimping unit associated with the wire, the crimping bed in said terminal crimping unit is raised while the crimping die is lowered to crimp the terminal. Therefore, when a wire not to have a terminal crimped thereto by said terminal crimping unit passes, the crimping bed is not raised, so that the wire passes above the crimping bed without getting a terminal.

In another preferred embodiment of the invention, there is provided a mechanism for adjusting the standard level of the crimping bed. This level adjusting mechanism has first and second disks adapted for surface contact with each other. The contact surface of each of the first and second disks is formed with two step portions disposed on opposite radii lying on a diameter, and two slopes circumferentially extending from the step portions and being the same in the direction of inclination when circumferentially seen. When the first disk is rotated, the second disk is linearly moved by the amount corresponding to the amount of rotation of the first disk, said linear movement being used for adjustment of the level of the crimping bed. According to the aforesaid preferred embodiment, the standard level of the crimping ben can be changed substantially steplessly, whereby differences in the diameter of wires to be treated can be advantageously accommodated.

These and other objects, features, aspects and advantages of the present invention will become more apparent from the following detailed description of the present invention when taken in conjunction with the accompanying drawings.

BRIEF DESCRIPTION OF THE DRAWINGS

FIG. 5 is a view taken in the direction of the line VI—VI in FIG. 3;

DESCRIPTION OF THE PREFERRED EMBODIMENTS AND OF THE BEST MODE OF THE INVENTION

Figure 1:
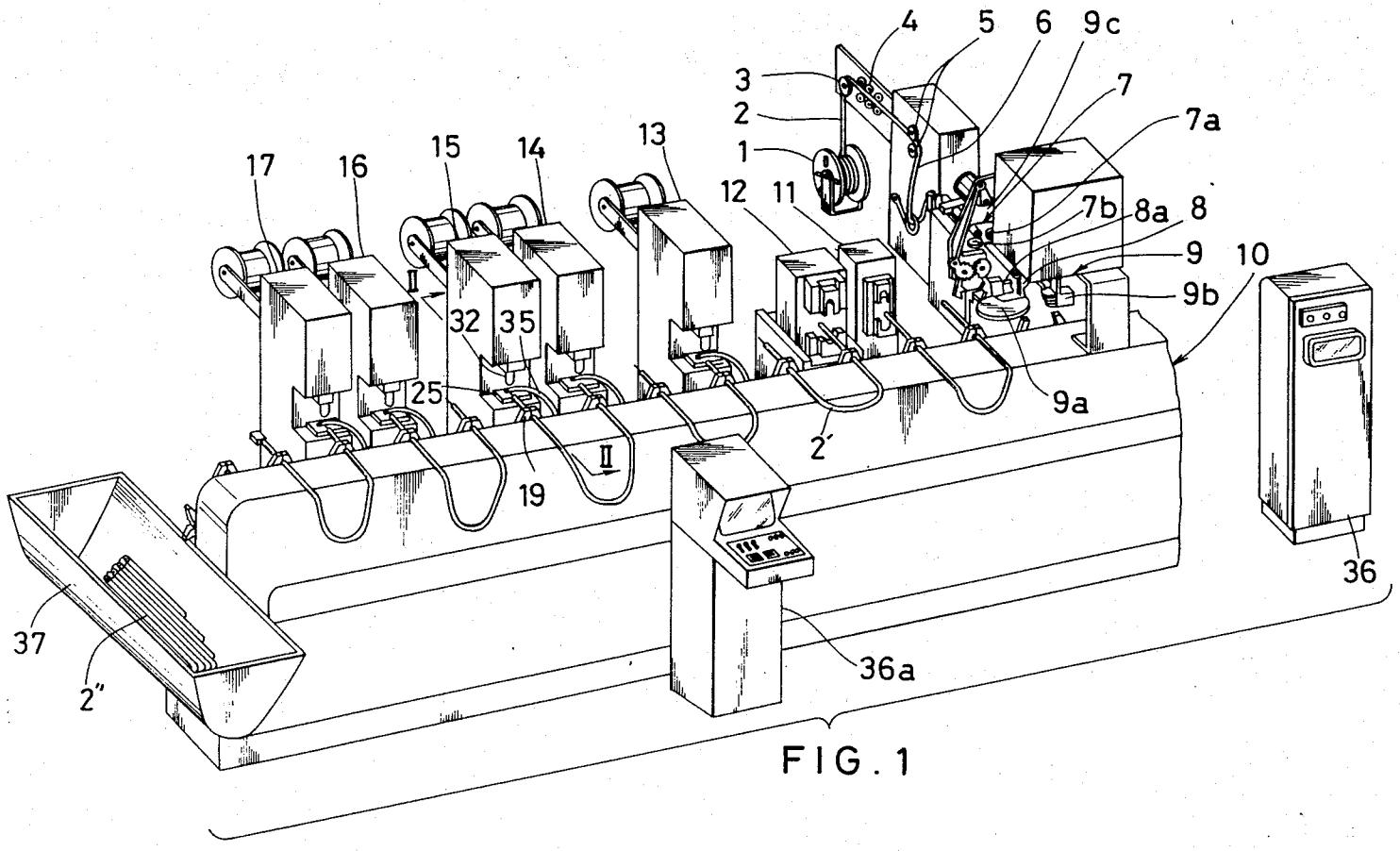
FIG. 1 is a perspective view showing the external appearance of a continuous terminal crimping machine according to an embodiment of the invention.

For the convenience of the description, the right hand end of the machine of FIG. 1 will be referred to as the upstream end because an upper run of a conveyor 10 moves from right to left, namely, toward a collecting container 37 in which finished wires 2'' are collected. Similarly, the left end of the machine in FIG. 1 is referred to as the downstream end for the same reason. The right side of the machine is the machine front and faces the viewer. The left side of the machine is the machine back and faces away from the viewer.

Referring to FIG. 1, a wire supply reel 1 has a wire 2 wound thereon. The wire 2 is fed from said reel 1 forward along a guide roller 3 and along a drawing roller group 4 by the continuous rotation of a pair of feed rollers 5, whereby said wire 2 travels through a sag forming section 6 to a length measuring feed device 7.

The aforesaid length measuring feed device 7 comprises a pair of length measuring rollers 7a and 7b, one roller 7a being rotated, the other roller 7b being connected to a length measuring unit (not shown) including a stepping motor.

A cutting device 8 having a pair of cutting blades 8a and a wire U-turn device 9 are arranged, one after the other, on the right-hand side of said length measuring feed device 7. A transfer conveyor 10 is disposed below said wire U-turn device 9. The conveyor 10 extends at a right angle to the direction in which the wire 2 if fed by the length measuring feed device 7. An equal size or length cutting unit 11, an insulation stripping unit 12, and various terminal crimping units 13, 14, 15, 16 and 17 are disposed along the side of said transfer conveyor 10 associated with said cutting device 8.

The aforesaid wire U-turn device 9 comprises a semicircular U-turn guide plate 9a, a U-turn roller assembly 9b angularly reciprocable for about 180° along the peripheral end surface of said U-turn guide plate 9a, and a clamp lifting body 9c having a lifting clamp, the arrangement being such that the wire 2 fed from the length measuring feed device 7 is caused to make a U-turn by cooperation between the U-turn guide plate 9a and the U-turn roller assembly 9b and is clamped by the lifting clamp. In this clamped state the wire 2 is cut to a predetermined length by the cutting device 8, whereupon the clamp lifting body 9c is lowered to hand the looped cut wire 2' over to the transfer conveyor 10.

The transfer conveyor 10 comprises an endless chain 18 (FIG. 2) entrained between a pair of spaced sprockets (not shown) disposed in the upstream and downstream ends, said endless chain 18 having a plurality of equispaced wire transfer units 19 attached thereto. The endless chain 18 is intermittently circulated in one direction by a reduction gear motor equipped with a clutch for driving the chain 18 through said sprockets.

Figure 2:
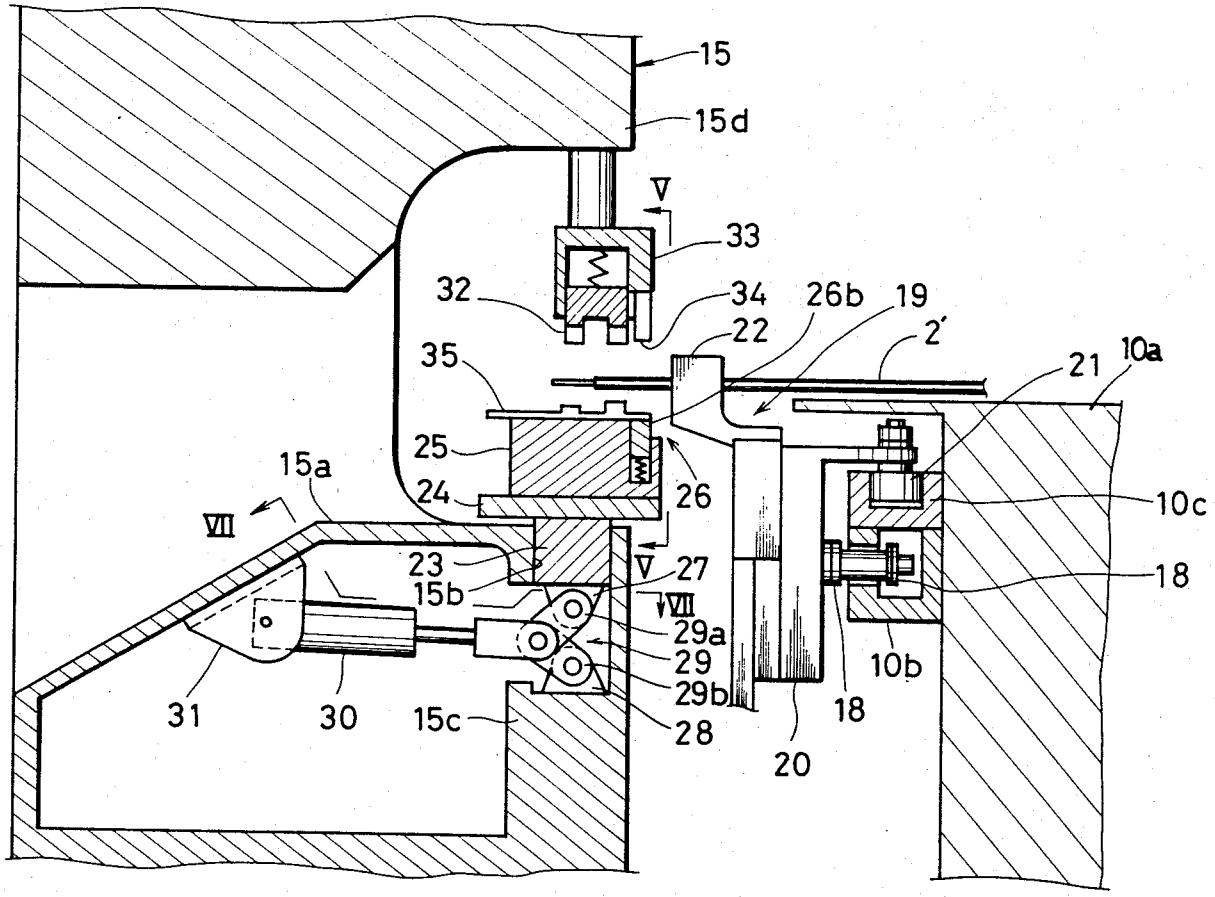
FIG. 2 is an enlarged sectional view taken along the line II—II in FIG. 1.

Referring to FIG. 2, a guide roller 21 is journaled on the horizontal front lower surface of the support plate 20 of the wire transfer unit 19. The guide roller 21 is rollably engaged with a guide track 10c having a U-shaped cross-section integral with a chain guide 10b fixed on the frame 10a of the transfer conveyor 10, thereby preventing swaying and falling-down of the entire wire transfer unit 19.

The numeral 22 denotes a pair of combtooth-like grip claws adapted to be maintained in its opened and closed states by an unillustrated machanism.

Referring to the terminal crimping unit 15, the lower frame 15a of the terminal crimping unit 15 is provided with a slide hole 15b in which a slider 23 is slidably fitted for upward and downward movement. The slider 23 has an attaching block 24 fixed thereon, with a crimping bed 25 attached to the upper surface of said attaching block 24. The crimping bed 25 is adapted to move vertically upward from a position below the level of the ends of the wires being transferred to the level of the ends of said wires. The right-hand side of the crimping bed 25 terminates in a cutting section 26 which comprises a lower cutter 26a (FIGS. 5 and 6) and a vertical member 26b vertically movable with an elastic force.

The numerals 27 and 28 denote link attaching metal elements, the link attaching metal element 27 being attached to the lower portion of the slider 23, the link attaching metal element 28 being attached to the fixing portion of the lower frame 15a.

The numeral 29 denotes a toggle link comprising link members 29a and 29b, the link member 29a being pivotally connected at one end thereof to the link attaching metal element 27, the link member 29b being pivotally connected at one end thereof to the link attaching metal element 28. The other ends of said link members 29a and 29b are connected to the front end of the rod of a cylinder 30. The cylinder 30 is pivotally connected to a cylinder attaching metal element 32 attached to the lower frame 15a.

A crimping die 32 is disposed above the crimping bed 25 and adapted to be moved upward and downward. A die holder 33 is adapted to be moved upward and downward by an unillustrated mechanism installed inside the upper frame 15d. The right-hand end of the die holder 33 terminates in an upper cutter 34.

While the terminal crimping unit 15 has been described so far, the other terminal crimping units 14, 16 and 17 are constructed in substantially the same manner as the terminal crimping unit 15. Different terminals 35 are used for different terminal crimping units.

FIG. 1, the character 26 denotes a control device containing a microcomputer; 36a denotes a console; and 37 denotes a container disposed at the terminal end of the transfer conveyor 10.

The terminal crimping machine described above is intended to continuously produce, in a given operation time, a number of different types of terminal-equipped cut wires used for example in one device. That is, in a particular device, there are used a plurality of different types of wires, each wire type comprising a particular number, of terminal-equipped cut wires which differ from each other in the diameter or length of the wire, in the type of the crimp terminal, and in whether terminals are applied to only one or both of the respective ends of the wire. For example, 100 terminal-equipped cut wires of a first type, and 20 terminal-equipped cut wires of a second type, and so on may be used. In this case, the operation proceeds in such a manner that in the continuously operating terminal crimping machine, first, 100 terminal-equipped cut wires of said first type are produced and then 20 terminal-equipped cut wires of said second type are produced. Thus, although only one set of equipment for producing cut wires 2' ranging from the wire supply reel 1 to the U-turn device 9 is shown in FIG. 1, actually, a plurality of such sets are provided for feeding cut wires of different diameters. For example, for terminal-equipped cut wires, the wire 2 fed from the wire feed reel 1 is used to provide cut wires 2', and the terminal crimping unit 15 is used to attach crimp terminals to the respective ends of the cut wires. In this case, the control device 36 commands that while these terminal-equipped cut wires of the first type are being produced, the wire 2 be fed from the wire supply reel 1 and that when a cut wire 2' being transferred by the transfer conveyor 10 reaches the terminal crimping unit 15, the latter be actuated. When the predetermined number of terminal-equipped cut wires of the first type have been produced, terminal-equipped cut wires of the second type will be produced and to this end a wire is fed from another suitable wire supply reel and a suitable terminal crimping unit will be actuated, e.g. unit 13.

Loop-like cut wires 2' successively produced by cooperation among the length measuring feed device 7, the cutting device 8 and the wire U-turn device 9. The looped wires are transferred by the transfer conveyor 10 whereby each cut wire 2' is gripped at both ends thereof by the gripping claws 22 of a wire transfer unit 19, and the insulation on the ends of the cut wires 2' is stripped by the insulation stripping unit 12.

Figure 3:
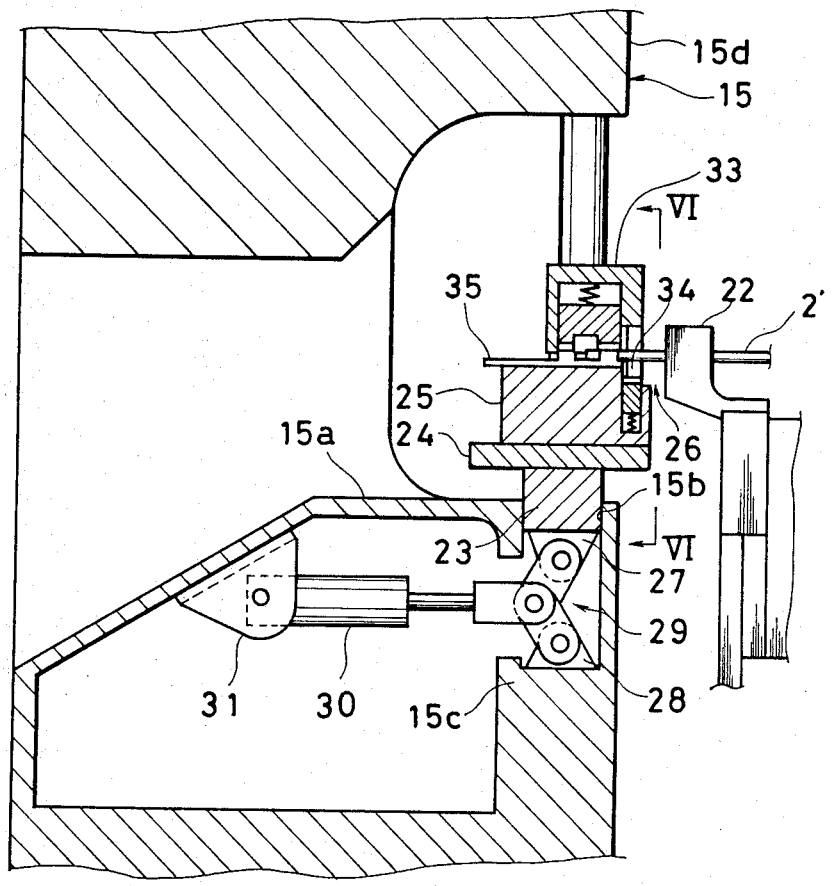
FIGS. 3 and 4 are sectional views similar to FIG. 2, but showing another state of operation.
Figure 5:
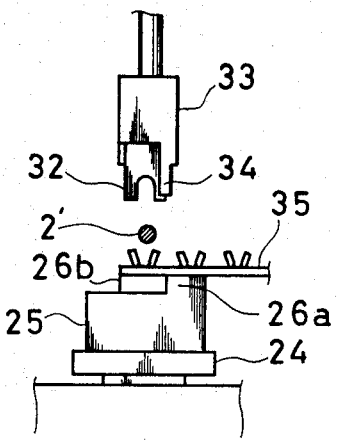
FIG. 5 is a view taken in the direction of the line V—V in FIG. 2.
Figure 6:
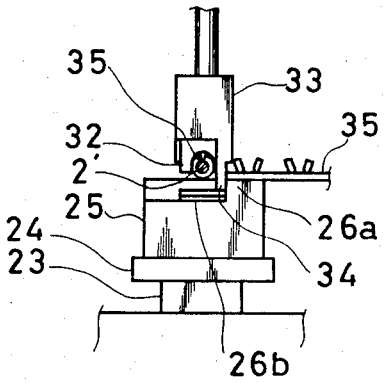
Figure 7:
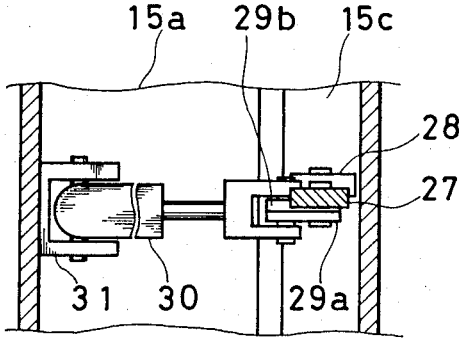
FIG. 7 is a view taken in the direction of the line VII—VII in FIG. 2.
Figure 8:
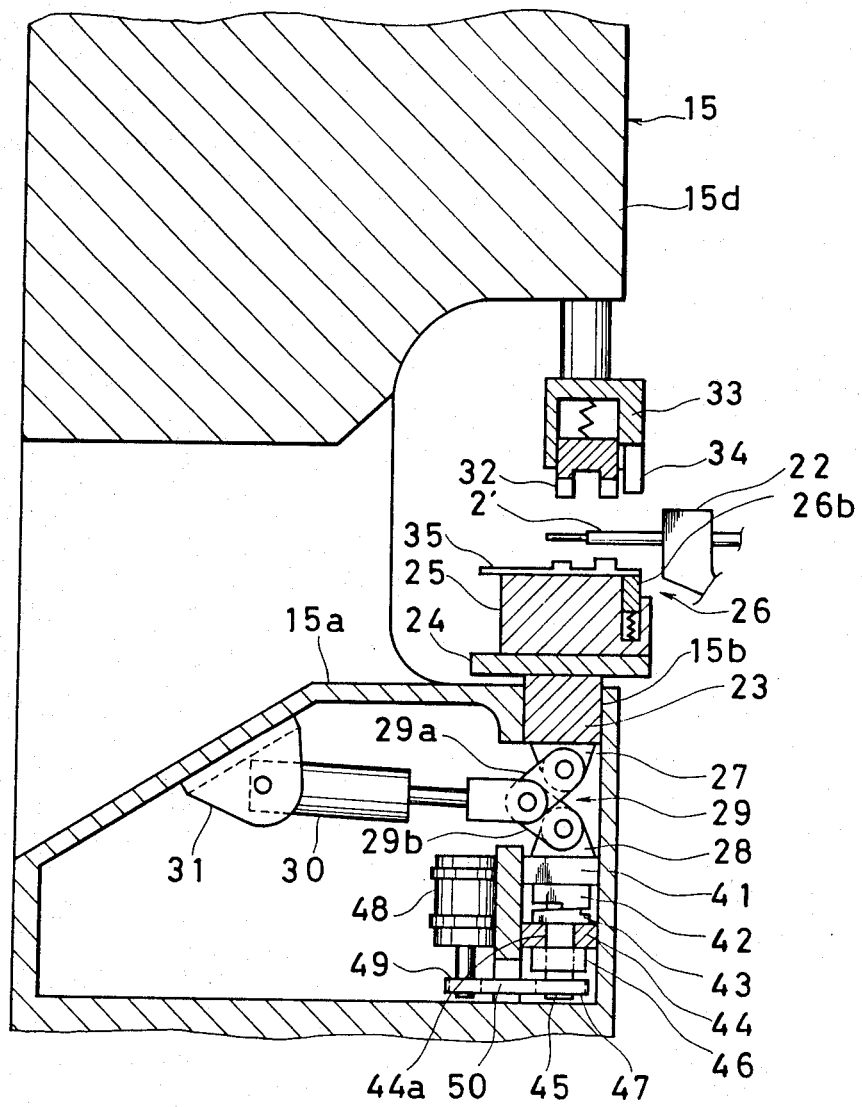
FIG. 8 is a sectional view similar to FIG. 2, but showing another embodiment of the invention.
Figure 9:
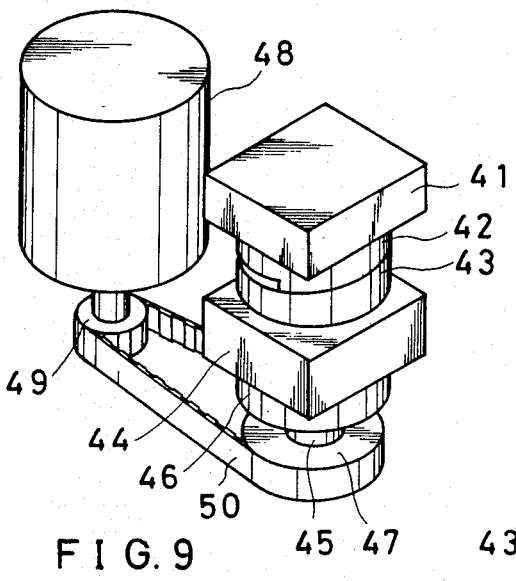
FIG. 9 is a perspective view showing a drive section for disks 42 and 43 shown in FIG. 8.
Figure 10:
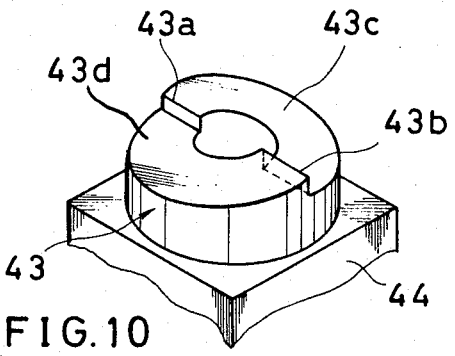
FIG. 10 is a perspective view showing the disk 43.

The cut wires 2' having the insulation stripped from their ends are transferred downstream toward the collecting container 37. Each of the cut wires 2' is stopped in accordance with control data indicating that the wires should have terminals crimped thereto by the terminal crimping unit 15. These control data hve been entered in the control device 36 for stopping the conveyor 10 and hence the wires carried by the conveyor 10 at the position where it is opposed to the terminal crimping unit 15 (FIGS. 2 and 5). The piston of a cylinder 30 is extended for the crimping operation, so that the slider 23 is raised by the link 29, causing a terminal 35 on the crimping bed 25 to move to a position immediately below the cut wire 2'. Subsequently, the die holder 33 is lowered by an unillustrated mechanism, said said terminal 35, which is one of a hoop of interconnected terminals, is severed from the rest by the upper and lower cutters 34 and 26*a* and is then crimped against the cut wire 2' by the crimping die 23 (see FIGS. 3 and 6).

Figure 4:
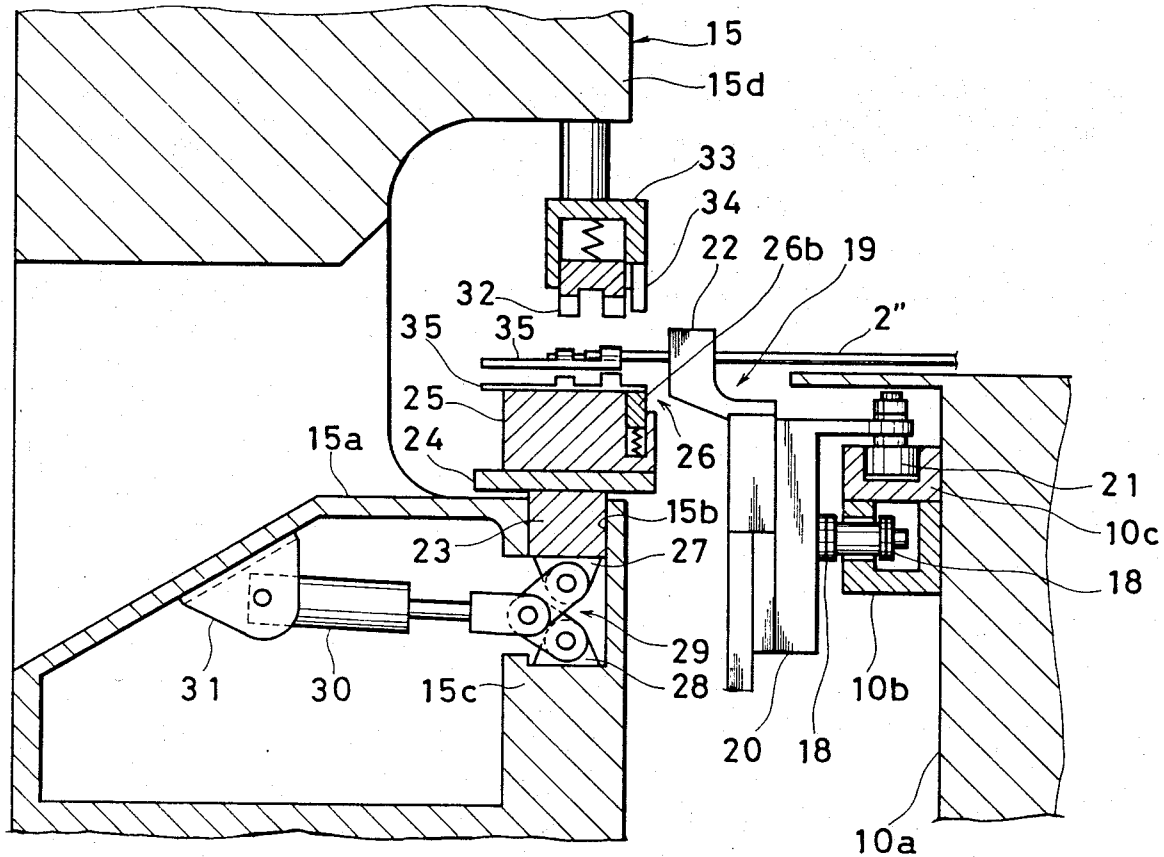

On completion of the crimping, the die holder 33 is raised back to its original position while the piston of the cylinder 30 is contracted to cause the link 29 to lower the crimping bed 25 back to its original position, and the hoop of terminals 35 is fed by an amount corresponding to one terminal, onto the crimping bed 25 (FIGS. 4 and 5). The wire 2" having the terminal crimped thereto (FIG. 4) is tranferred downstream and received in the container 37 (FIG. 1).

Due to the lowering of the crimping bed, a wire having a terminal likewise crimped thereto by the terminal crimping unit 13 or 14 passes over, rather than colliding with, a terminal placed on the crimping bed 25 of the terminal crimping unit 15. Further, a wire to have a terminal crimped thereto by the terminal crimping unit 16 or 17 likewise passes over, rather than colliding with, a terminal 35 placed on the crimping bed 25.

Thus, in accordance with signals stored to the control device 36, wires of different lengths and terminals of different types are crimped together in a continuous manner by the terminal crimping units.

As described above, this embodiment comprises a plurality of terminal crimping units 13 to 17 disposed laterally of a wire transfer conveyor 10. The crimping bed of each terminal crimping unit is adapted to be vertically moved from a position below the level of the ends of wires being transferred to the level of the ends of said wires. The arrangement is such that in accordance with signals from a control device 36, when a wire corresponding to a particular terminal crimping unit is transferred to said particular terminal crimping unit, the crimping bed of said crimping unit is raised while the crimping die is lowered to perform the terminal crimping. As a result of this arrangement, a wire which does not correspond to a terminal crimping unit is fed downstream without colliding with a terminal placed on the crimping bed, so that terminals of different lengths and different types can be continuously crimped to wires without any possibility of the wires being bent. Thus, the external appearance and marketable value of the product are improved.

Another embodiment of the invention will now be described. This embodiment is constructed so that a single terminal crimping unit is capable of crimping terminals against wires of different diameters. More particularly, there is provided a level adjusting mechanism associated with the crimping bed to cope with different wire diameters.

FIGS. 8 to 12 are views for explaining the second embodiment. In addition, in FIG. 8, which corresponds to FIG. 2, the parts corresponding to those shown in FIG. 2 are indicated by the same reference characters to avoid a repetitive description. In this second embodiment, as can be seen by comparing FIG. 8 with FIG. 2, the link attaching metal element 28 is provided on a vertically displaceable link attaching block 41, rather than on a fixing element 15*c* (FIG. 2).

The numerals 42 and 43 denote doughnut-like disks vertically opposed to each other, the opposed surfaces of said disks being shaped so that the correspond to each other. The upper end surface of the disk 43 is provided with two step portions 43*a* and 43*b* disposed on diametrically opposite sides. One side 43*c* of the end surface is in the form of a slope with a fixed difference in level extending from the high position on one step portion 43*a* to the low position on the other step portion 43*b*. The other side 43*d* of the end surface is in the form of a slope with a fixed difference in level extending from the low position on one step portion 43*a* to the high position on the other step portion 43*b*.

Figure 11:
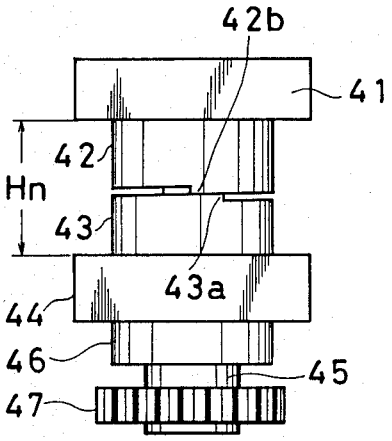
FIGS. 11 and 12 are front views showing the operative states of the disks 42 and 43, respectively.
Figure 12:
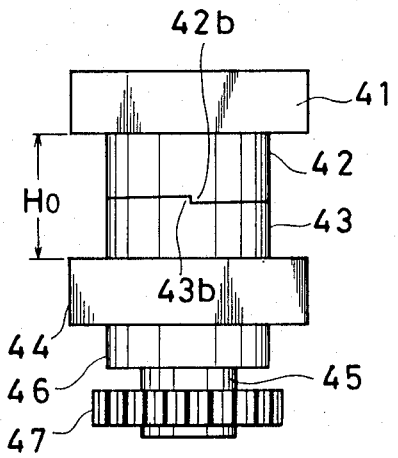

The lower surface of the disk 42 is shaped in the same manner. When these end surfaces are contacted with each other so that their step portions are disposed in the same angular positional relationship, as shown in FIG. 12, the two end surfaces are contacted with each other over the entire area, when the height from the lower surface of the disk 43 to the upper surface of the disk 42 is at a minimum Ho. As the disk 43 is rotated, clearance are formed between the step portions 42*a* and 42*b* and the step portions 43*a* and 43*b*. The clearance becomes respectively, the greater the greater the degree of rotation. In FIG. 11, the disk 43 is rotated so that the disks 42 and 43 are contacted with each other over the areas between the step portions 42*b* and 43*b* and the step portions 42*a* and 43*b* (not shown), with clearances formed in the other area, with the result that the height between the lower surface of the disk 43 and the upper surface of the disk 43 is Hn, which is greater than Ho in FIG. 12.

Since the slopes on the end surfaces 43*c* and 43*d* of the disk 43 change with a fixed difference in level and since the end surfaces of the corresponding disk 42 also change in the same manner, the height between the lower and upper surfaces of the disk 43 changes steplessly in proportion to the degree of rotation of the disk 43.

If the rate of change of height of the slope is changed to some other rate, the height between the lower surface of the disk 43 and the upper surface of the disk 42 can be changed at some other rate.

A lower fixing portion 44 is provided is a plate, secured to the lower frame 15*a* below a slide hole 15*b*. The lower fixing portion 44 has a hole 44*a*, in which a rotary shaft 45 for the disk 43 is fitted. The rotary shaft 45 is engaged with a brake 46 attached to the lower fixing portion 44 and has a gear 47 fixed on the lower end thereof. A stepping motor 48 is attached to the lower frame 15*a*, and a gear 49 fixed on the shaft end thereof is connected to said gear 47 by a toothed belt 50. Therefore, the disk 43 can be rotated in increments of a fraction of one complete revolution by a stepping motor 48. The disks 42 and 43 and the stepping motor 48 which are disposed in opposed relationship to each other provides a level adjusting function for changing an elevational level by a rotation.

Thus, the cut wires 2' having their insulation stripped from their ends are transferred downstream. Each wire 2' is stopped in accordance with data in the control device 36 indicating that the wire should have terminals crimped thereto by the terminal crimping unit 15. Specifically the conveyor 10 is stopped at the position where the respective were is opposed to the terminal crimping unit 15. The stepping motor 48 is rotated in response to a signal from the control device 36 based on wire diameter data stored in the control device 36, whereby the height between the lower surface of the disk 43 and the upper surface of the disk 42 is changed by the gears 49, the toothed belt 50 and the gear 47.

The subsequent crimping process is performed in the same manner as in the first embodiment described previously. The crimping bed 25 is pushed up by the piston of the cylinder 30 and the link 29 from the standard height which as been changed in the manner described above. Therefore, the clearance betwen the crimping bed 25 and the crimping die 32 is adjusted to accommodate the change in the diameter of the wire to be treated.

In each of the terminal crimping units 13, 14, 16 and 17, terminal crimping of a wire of different diameter is likewise satisfactorily effected through level adjustment made by the rotation of the opposed disk by the stepping motor in response to a signal from the control device 36.

While a stepping motor has been used in the above embodiment, the same merit can be obtained by using other servo motors such as a brushless motor.

While a pair of disks 42 and 43 having slopes on their mutually contacting surfaces have been used as a level adjusting mechanism for changing level with rotation in the above embodiment, this arrangement may be replaced by a cam mechanism or a combination of an externally threaded shaft and a nut-like member threadedly fitted thereon.

As described above, according to the second embodiment, the level of the crimping bed is substantially steplessly variable through rotation as by a stepping motor. The rotation is made in increments of a fraction of a complete revolution, so that the level of the crimping bed can be easily and steplessly adjusted and terminals can be reliably crimped against wires of various diameters. Further, since the servo motor such as a stepping motor rotates in response to the size of the respective signal, a crimp adjustment in accordance with the wire diameter can be easily automated.

Although the present invention has been described and illustrated in detail, it is clearly understood that the same is by way of illustration and example only and is not to be taken by way of limitation, the scope of the present invention being limited only by the terms of the appended claims.

What is claimed is:

1. A terminal crimping machine comprising wire transfer conveyor means having a plurality of wire transfer units for gripping and holding insulated wires which are cut to predetermined lengths at a given reference elevational level, said wire transfer conveyor means travelling along a transfer path for intermittently advancing said wire transfer units through said transfer path, an insulation stripping unit disposed laterally of said transfer path for stripping insulation from ends of said insulated cut wires, at east one terminal crimping unit disposed laterally of said transfer path in a location downstream of said insulation stripping unit as viewed in a travel direction of an upper run of said transfer conveyor means, said terminal crimping unit comprising a terminal crimping bed adapted to vertically move from a position below said given reference elevational level of the ends of wires being transferred to said given reference elevational level of the ends of said wires, a crimping die disposed above said crimping bed and adapted for vertical movement for crimping terminals, and position adjusting means connected to said terminal crimping bed for adjusting an elevational position of said terminal crimping bed to a desired elevational level relative to said given reference elevational level.

2. The terminal crimping machine of claim 1, wherein a plurality of said terminal crimping units are provided along said transfer path.

3. The terminal crimping machine of claim 2, further comprising a control device which controls the operation of said crimping units in such a manner that a wire corresponding to a particular one of said terminal crimping units is fed to said particular terminal crimping unit in response to a signal from said control device, said control device further controlling said position adjusting means so that the corresponding crimping bed is raised while the respective crimping die is lowered for performing a terminal crimping operation, and so that wires which do not correspond to said particular terminal crimping unit are allowed to pass said particular crimping unit.

4. The terminal crimping machine of claim 1, wherein said crimping bed comprises a slide portion adapted for a vertical sliding movement relative to a fixing portion, a toggle link connected between said slide portion and said fixing portion, and an extensible piston cylinder device connected to a joint of said toggle link for moving said crimping bed vertically by an extension and contraction of said extensible piston cylinder device.

5. The terminal crimping machine of claim 1, wherein said position adjusting means comprise first and second elements forming a pair, the arrangement being such that said second element performs a linear movement in proportion to a degree of rotation of said first element, said linear movement being used for adjustment of an elevational level of said crimping bed.

6. The terminal crimping machine of claim 5, wherein said first and second elements respectively comprise first and second disks with respective surfaces in contact with each other, said contact surfaces of said first and second disks each having two step portions positioned on opposed radii lying on a diameter, and two slopes which extend circumferentially from said step portions and which are the same in the direction of inclination as seen in a circumferential direction.

7. The terminal crimping machine of claim 5, further comprising a servo motor for rotating said first element.

8. The terminal crimping machine of claim 7, wherein said servo motor is a stepping motor.

* * * * *